US005363767A

United States Patent [19]

Robinson

[11] Patent Number: 5,363,767

[45] Date of Patent: Nov. 15, 1994

[54] STAND-OFF WEAPONS

[75] Inventor: Philip I. Robinson, Cheshire, Great Britain

[73] Assignee: British Aerospace Public Limited Company, London, England

[21] Appl. No.: 629,105

[22] Filed: Dec. 12, 1990

[30] Foreign Application Priority Data

Dec. 14, 1989 [GB] United Kingdom ..... 8928270.1

[51] Int. Cl.[5] ..... F42B 15/10; B64C 1/28

[52] U.S. Cl. ..... 102/374; 102/293; 244/120

[58] Field of Search ..... 89/1.11; 102/293, 374, 102/489; 244/3.1, 2, 120

[56] References Cited

U.S. PATENT DOCUMENTS

| | | | |
|---|---|---|---|
| 2,503,271 | 4/1950 | Hickman | 102/374 |
| 2,779,282 | 1/1957 | Raffel | 102/374 |
| 2,976,806 | 3/1961 | Risk et al. | 102/293 |
| 3,703,998 | 11/1972 | Girard | 244/2 |
| 3,735,985 | 5/1973 | Layer et al. | 102/374 |
| 4,196,669 | 4/1980 | Weidenhagen et al. | 102/489 |
| 4,455,943 | 6/1984 | Pinson | 102/489 |
| 4,834,324 | 5/1989 | Criswell | 244/2 |
| 4,896,845 | 1/1990 | Peretti et al. | 244/3.1 |

FOREIGN PATENT DOCUMENTS

| | | | |
|---|---|---|---|
| 0227211 | 7/1987 | European Pat. Off. . | |
| 874831 | 8/1961 | United Kingdom . | |
| 1027918 | 4/1966 | United Kingdom . | |
| 1027919 | 4/1966 | United Kingdom . | |
| 1038127 | 8/1966 | United Kingdom . | |
| 1596216 | 8/1981 | United Kingdom . | |
| 1605122 | 12/1981 | United Kingdom . | |
| 2205798 | 12/1988 | United Kingdom | 244/2 |
| WO86/01175 | 2/1986 | WIPO . | |

*Primary Examiner*—David Brown
*Attorney, Agent, or Firm*—Nixon & Vanderhye

[57] ABSTRACT

A guided missile for air to ground deployment having a modular construction which can be readily configured to suit varying deployment roles. The missile comprises a common central fuselage 1, 2, 3 carrying a fuel tank and mounting points for an engine, wings and nose-cone 7. Bolted onto either side of the fuselage are panniers *6a, 6b* of variable length and payload capacity. In one embodiment the panniers *6a, 6b* carry munitions for lateral ejection through frangile panels. In an alternative embodiment, munitions are mounted in the fuselage and the panniers carry fuel.

10 Claims, 2 Drawing Sheets

STAND-OFF WEAPONS

BACKGROUND OF THE INVENTION

1. Field of the Invention

This invention relates to guided missiles and particularly to missiles deployed from an aircraft for attacking ground-based targets remote from the aircraft. This type of missile is sometimes referred to as a stand-off weapon.

2. Discussion of Prior Art

A known missile suitable for deployment as mentioned above has a modular construction incorporating a central payload bay to which other necessary parts of the missile such as nose cone, hardback assembly and engine, are attached.

The roles that a stand-off weapon has to play are various and diverse depending on the target in question, i.e., different targets require different payloads. Hence the missile having a central payload is restricted in its versatility; a complete missile must be purpose-built for the particular role to be fulfilled.

SUMMARY OF THE INVENTION

An object of this invention is to provide a missile having greater versatility than the type described above. A further object is to provide a missile which is easily configured to suit the various roles during the build-line process. Missiles for differing roles should also share as many common components as possible in order to keep production costs low.

The invention therefore comprises a guided missile of modular construction consisting of:

a central fuselage incorporating a fuel tank and having mounting points for missile propulsion means, wings and nose cone;

and releasably attachable payload carriers positioned on either side of the fuselage.

Preferably, the carriers are bolted onto the fuselage.

Thus the invention provides a light-weight and efficient structure having greater versatility compared with existing "central payload bay" modular missiles. This is achieved by using a single structure, viz the central fuselage, to perform several tasks. By using detachable payload modules, the missile can be readily configured to suit role requirements without the need to modify any major structural interfaces of the missile. Thus, the missile's role may be changed simply by changing the carriers whilst the basic missile structure is kept intact.

A further advantage is reduced production cost because of the small number of components comprising the missile and the reduced number of major interfaces between structural elements.

In one embodiment the payload carriers comprise munition carrying panniers which run almost the full length of the fuselage. This configuration is preferred for the deployment of laterally ejected munitions for long range or multiple targets. The panniers could be restricted in length for short range, single target applications.

The panniers could alternatively be used to carry fuel and/or avionics equipment in which case munitions are located within the central fuselage.

Munitions may be released from the panniers by known techniques which involve pyrotechnic-device initiated pressure-driven piston systems. The munitions may exit the panniers through frangible panels, for example.

BRIEF DESCRIPTION OF THE DRAWINGS

Some embodiments of the invention will now be described with reference to the drawings of which.

DETAILED DISCUSSION OF PREFERRED EMBODIMENTS

Figure 1A:
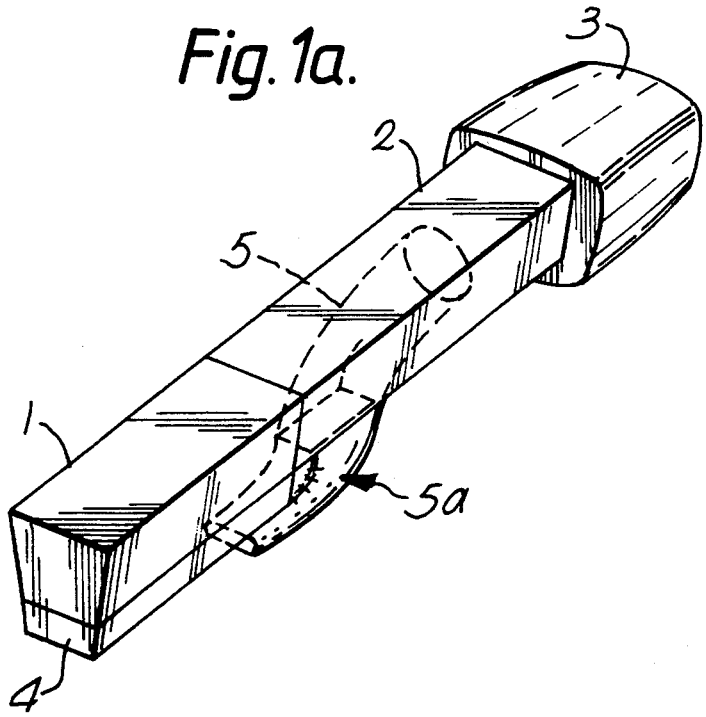
FIGS. 1*a* and 1*b* are schematic diagrams of the basic constituent parts of a missile in accordance with the invention.

In FIG. 1*a* a central fuselage for a missile is composed of a forward module 1, a midsection module 2 and a rear module 3. The module 1 forms part of the main fuel tank while module 2 provides the main structural element of the vehicle and incorporates mounting points (not shown) for wings and hardback assembly and also incorporates part of the main fuel tank. The rear module 3 provides an engine mounting structure. (The wings, hardback assembly and engine have been left off the Figure for the sake of clarity). An avionics module 4 is mounted on the underside of the forward module 1. The avionics module is self-contained and access for maintenance is gained from the underside of the missile. An intake duct for an engine is formed as an integral part of the midsection module 2. A lower portion 5*a* of the intake duct is articulated (by conventional means) in order to provide a smooth external profile for ground clearance and for carriage whilst installed on an aircraft.

Figure 1B:
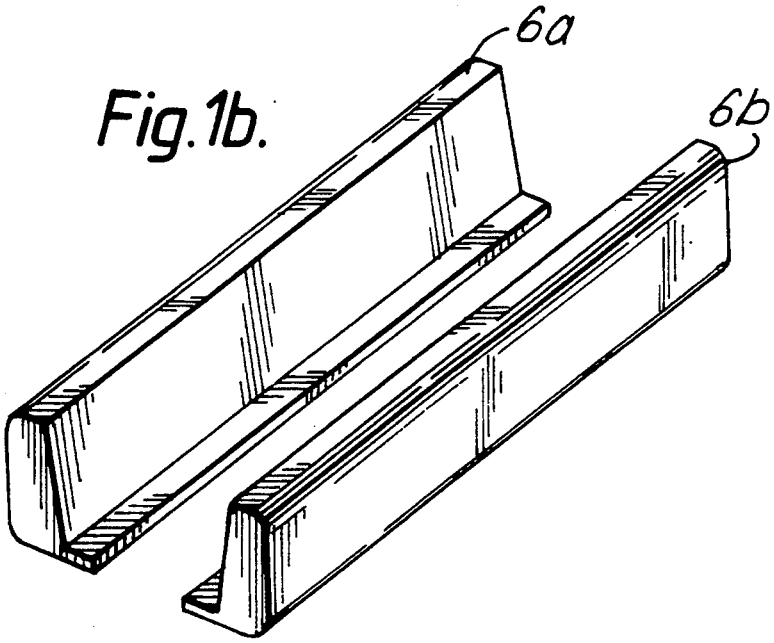
Figures 2, 3:
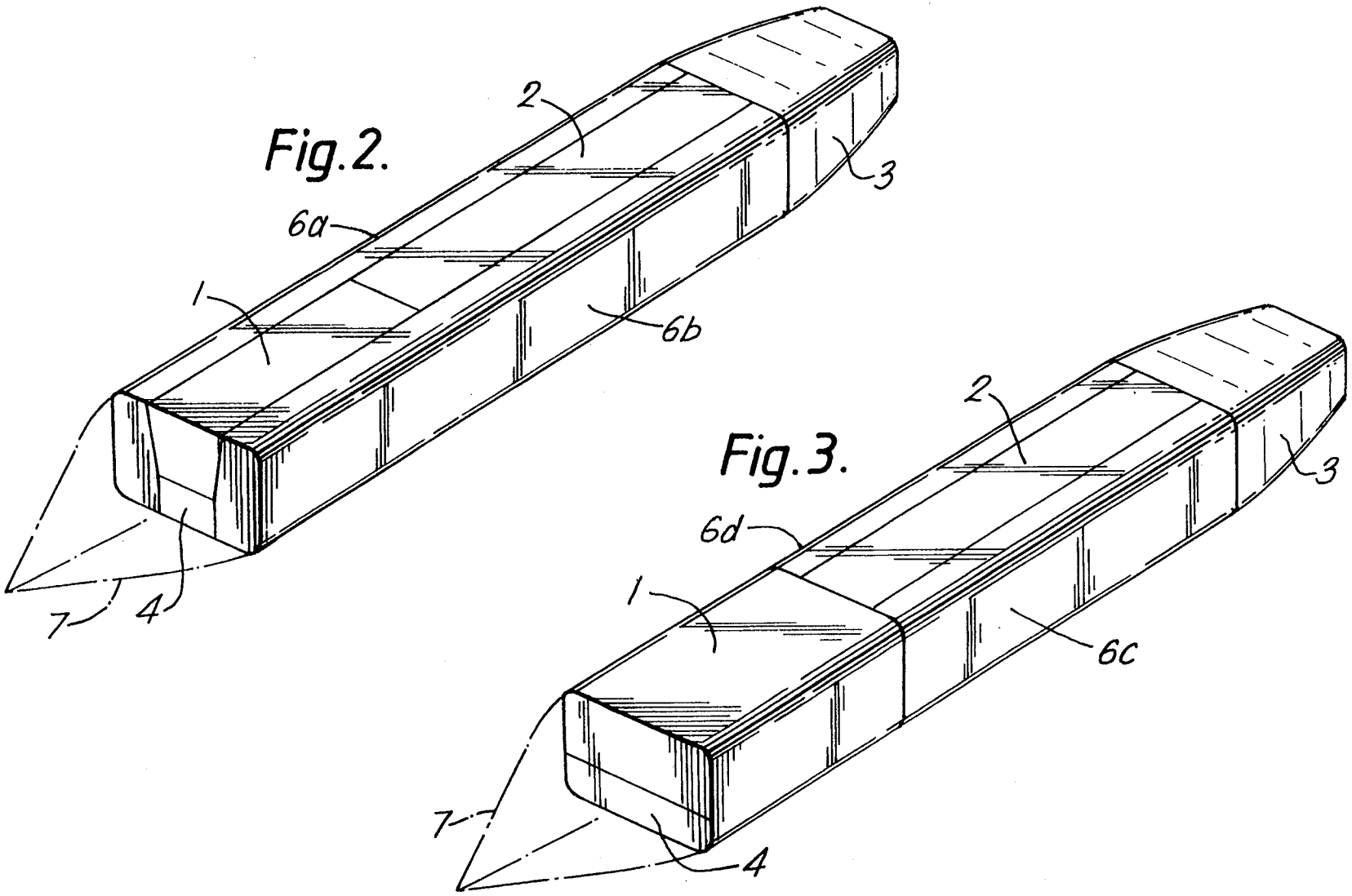
FIGS. 2 and 3 are schematic diagrams illustrating two alternative embodiments of the invention.

FIG. 1*b* shows a pair of munition carrying panniers 6*a*, 6*b* which fit either side of the central fuselage. (See FIG. 2). FIG. 2 also shows the position of the nose-cone 7 of the missile. The panniers 6*a*, 6*b* run almost the full length of the fuselage and are bolted into position. The panniers have frangible panels 8 through which munitions 9 can be ejected laterally (arrow) by means of pressure driven pistons also stored within the panniers.

In an alternative embodiment, shown in FIG. 3, the panniers 6*c*, 6*d* are of reduced length and house fuel tank 10 and avionics equipment. Munitions for vertical and horizontal release are stored in the forward module 1.

I claim:

1. A fuselage for a flying guided missile said fuselage having a modular construction comprising:

a central fuselage incorporating a fuel tank and nose cone;

and releasably attachable payload carriers positioned on either side of said central fuselage wherein said carriers include munitions ejectable during flight of said guided missile wherein the carriers are provided with frangible panels through which munitions installed in the carriers can be ejected.

2. A fuselage according to claim 1 wherein the carriers are bolted onto the fuselage.

3. A fuselage according to claim 1 wherein the carriers incorporate at least one fuel tank.

4. A fuselage according to claim 3, wherein said carriers form an external, aerodynamic surface of said missile.

5. A fuselage according to claim 3, wherein the carriers are bolted onto the fuselage.

6. A fuselage according to claim 1, wherein said carriers form an external, aerodynamic surface of said missile.

7. A fuselage according to claim 6, wherein said carriers contain a plurality of munitions.

8. A fuselage according to claim 6, wherein the carriers are bolted onto the fuselage.

9. A fuselage according to claim 1, wherein said carriers contain a plurality of munitions.

10. A fuselage according to claim 9 wherein the carriers are bolted onto the fuselage.

* * * * *